US007311442B1

(12) United States Patent
Moravek

(10) Patent No.: US 7,311,442 B1
(45) Date of Patent: Dec. 25, 2007

(54) AIR VALVE FOR A FILLABLE POLY BAG

(76) Inventor: Lawrence R. Moravek, 100 W. Roosevelt Rd., Bldg. B-8, Suite 103A, Wheaton, IL (US) 60187

( * ) Notice: Subject to any disclaimer, the term of this patent is extended or adjusted under 35 U.S.C. 154(b) by 271 days.

(21) Appl. No.: 10/885,816

(22) Filed: Jul. 6, 2004

(51) Int. Cl.
*B65D 30/24* (2006.01)
*B65D 33/01* (2006.01)
*B65D 33/00* (2006.01)

(52) U.S. Cl. ..... 383/45; 383/44; 383/100; 383/94; 383/50; 383/53; 383/58; 383/46; 383/48

(58) Field of Classification Search ..... 383/45, 383/100, 904, 44, 46, 48, 50, 53, 58
See application file for complete search history.

(56) References Cited

U.S. PATENT DOCUMENTS 3,117,711 A * 1/1964 Camerini ..... 383/126
3,276,670 A 10/1966 Harvey
3,297,234 A * 1/1967 Honsel et al. ..... 383/45
3,399,822 A * 9/1968 Kugler ..... 383/103
3,430,842 A * 3/1969 Yamaguchi ..... 383/45
3,618,478 A 11/1971 Piazze
3,904,107 A * 9/1975 Nishimura et al. ..... 383/45
4,391,404 A * 7/1983 Welter ..... 383/46
4,571,235 A 2/1986 Benoit
4,655,737 A 4/1987 Benoit
4,672,688 A * 6/1987 Kalkipsakis ..... 383/58
4,717,262 A 1/1988 Roen et al.
4,764,030 A 8/1988 Humphrey
4,816,104 A 3/1989 Benoit
4,881,825 A 11/1989 Olesen
4,913,561 A 4/1990 Beer
4,943,167 A 7/1990 Gelbard
4,959,114 A 9/1990 Mundus
5,165,799 A 11/1992 Wood
5,676,467 A 10/1997 Gebhardt
5,862,652 A 1/1999 Schoeler
6,074,095 A * 6/2000 Bannister et al. ..... 383/54
RE36,876 E 9/2000 Daniels et al.
6,213,645 B1 4/2001 Beer
6,254,520 B1 7/2001 Angless
6,997,858 B1 * 2/2006 Moravek ..... 493/212

* cited by examiner

*Primary Examiner*—Nathan J. Newhouse
*Assistant Examiner*—Avery Prioleau
(74) *Attorney, Agent, or Firm*—Dillis V. Allen, Esq.

(57) ABSTRACT

An air valve for a poly bag that permits the escape of air from the bag as it is filled by a filling tube. The air valve consists of a plurality of slitted openings in one top corner of the bag and a valve flap mounted in the poly bag near the slitted openings that closes and seals the openings as filling material engages and moves the flap.

10 Claims, 5 Drawing Sheets

AIR VALVE FOR A FILLABLE POLY BAG

BACKGROUND OF THE INVENTION

Side gusseted paper bags have been commercially made for many years with openings that permit bag charging or filling. But these bags are quite costly, not only because of the additional materials needed about the bag filling opening, but also because of the labor and time to close and seal the bag.

One of the problems with fillable bags is the entrapment of air during the filling process which promotes poor filling and other problems.

The following patents were found in a preliminary patentability search:

| | U.S. patents | |
|---|---|---|
| Inventor | U.S. Pat. No. | Issue Date |
| Harvey | 3,276,670 | Jul. 27, 1964 |
| Piazze | 3,618,478 | Nov. 9, 1971 |
| Benoit | 4,571,235 | Feb. 18, 1986 |
| Benoit | 4,655,737 | Apr. 7, 1987 |
| Roen, et al. | 4,717,262 | Jan. 5, 1988 |
| Humphrey | 4,764,030 | Aug. 16, 1988 |
| Benoit | 4,816,104 | Mar. 28, 1989 |
| Olesen | 4,881,825 | Nov. 21, 1989 |
| Beer | 4,913,561 | Apr. 3, 1990 |
| Gelbard | 4,943,167 | Jul. 24, 1990 |
| Mundus | 4,959,114 | Sep. 25, 1990 |
| Wood | 5,165,799 | Nov. 24, 1992 |
| Gebhardt | 5,676,467 | Oct. 14, 1997 |
| Schoeler | 5,862,652 | Jan. 26, 1999 |
| Daniels, et al. | Re.36,876 | Sep. 19, 2000 |
| Beer | 6,213,645 | Apr. 10, 2001 |
| Angless | 6,254,520 | Jul. 3, 2001 |

UNITED STATES PATENT APPLICATION PUBLICATION

Totani Pub. No.: US 2001/0002938
Pub. Date: 7-7-01

FOREIGN PATENTS

Interpoly Limited, UK Patent Application
GB 2 226 541A
Publication Date: 4-7-90

The Harvey, U.S. Pat. No. 3,276,670, shows a tapered side gusseted bag but has no filling valve. The Piazze, U.S. Pat. No. 3,618,478, shows a gusseted bottom bag with diagonal heat seals but has no filling valve either.

The Benoit, U.S. Pat. Nos. 4,571,235 and 4,816,104, show a T-shirt bag with diagonal heat seals at the bottom. Again, it has no filling valve. The Benoit, U.S. Pat. No. 4,655,737, is duplicative with respect to the Benoit '235 patent.

The Roen, et al., U.S. Pat. No. 4,717,262, shows a gusseted bottom bag with diagonal heat seals and a sine wave handle. The Humphrey, U.S. Pat. No. 4,764,030, shows serrated bags on a roll but no discharge or filling valve.

The Olesen, U.S. Pat. No. 4,881,825, discusses both a filling valve and a discharge valve and a "block" style bottom and top, formed by folding and overlapping the ends of an open tube onto itself much like gift wrapping a box but tucking the sides inwardly and then folding the paper onto itself. See FIG. 10, for example. The discharge valve is for the purpose of pouring product out of the bag and no details are shown of the charging features in Olesen's bag.

The Beer, U.S. Pat. No. 4,913,561, shows what appears to be a valve on the upper left corner of the bag but rather than that, it is a heat seal which is intended to allow the bag to square once it is filled with product.

The Gelbard, U.S. Pat. No. 4,943,167, shows a side gusseted T-shirt bag made three across at one time and involves the continuous slitting and heat sealing of one tube longitudinally into three longitudinal tubes, post gusseting and heat sealing to create a top and bottom of the bag.

The Mundus, U.S. Pat. No. 4,959,114, shows a method which includes feeding flat sheet roll stock, folding it over into two, post gusseting it and sealing it into gusseted tubing with a longitudinal heat seal and then trimming off the excess.

The Wood, U.S. Pat. No. 5,165,799; the Gebhardt, U.S. Pat. No. 5,676,467; the Schoeler, U.S. Pat. No. 5,862,652; the Daniels, et al., Re.36,876; the Beer, U.S. Pat. No. 6,213,645; the Angless, U.S. Pat. No. 6,254,520; the Totani, Pub. U.S. 2001/0002938, published Jul. 7, 2001; and the Interpoly Limited U.K. Patent Application GB 2 226 541A, published Apr. 7, 1990, all show gusseted bags, gusseted T-shirt bags, laminated film structure gusseted bags, tri-folded bags, post-bag making, and a separate bottom panel system sealed into a tube on four sides that shows an accordion type bag. None of these latter patents have filling systems.

It is a primary object of the present invention to ameliorate the problems noted above in prior art chargeable bags.

SUMMARY OF THE PRESENT INVENTION

In accordance with the present invention, an air valve for a polybag is provided that permits the escape of air from the bag as it is filled by a filling tube. The air valve consists of a plurality of slitted openings in one top corner of the bag and a valve flap mounted in the polybag near the slitted openings that closes and seals the openings as filling material engages and moves the flap.

The valve flap is generally rectangular and constructed of a material similar to the polybag itself. It may be heat sealed behind one of the panels of the polybag adjacent the corner of the bag where the filling tube is inserted. This location is selected because it is the area of bag that is last to fill. The bag fills diagonally toward that corner because of the filling tube orientation.

The openings in the polybag itself are crossed slits to achieve better sealing by the flap valve, while the holes in the flap valve are circular to promote air flow.

In some cases the holes in the flap valve may be eliminated because, depending upon bag construction, air may flow around the flap valve out the polybag slitted openings. The holes in the flap valve prevent the premature closing of the polybag air openings.

Other objects and advantages will appear more clearly from the following detailed description.

DETAILED DESCRIPTION OF THE PREFERRED EMBODIMENT

Figure 8:
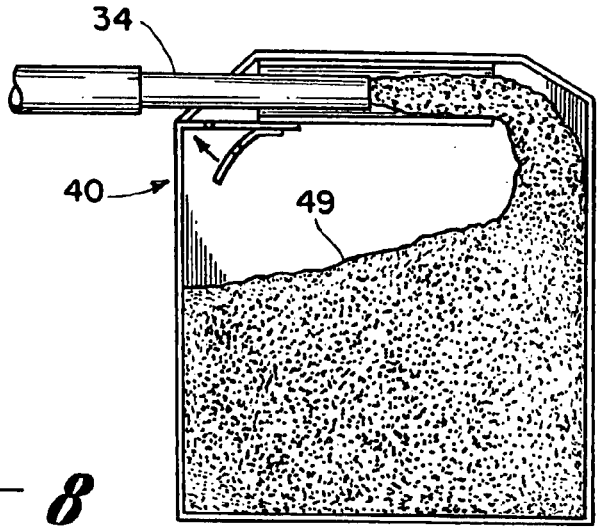
FIG. 8 is similar to FIG. 7 about 60% filled.
Figure 9:
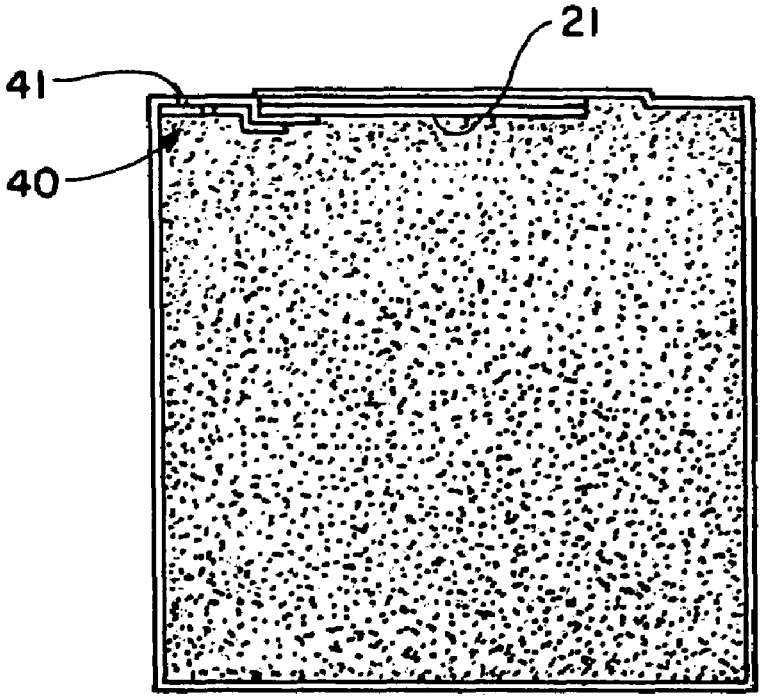
FIG. 9 is a vertical section similar to FIGS. 7 and 8 with the filling tube flap valve in its sealed position.
Figure 10:
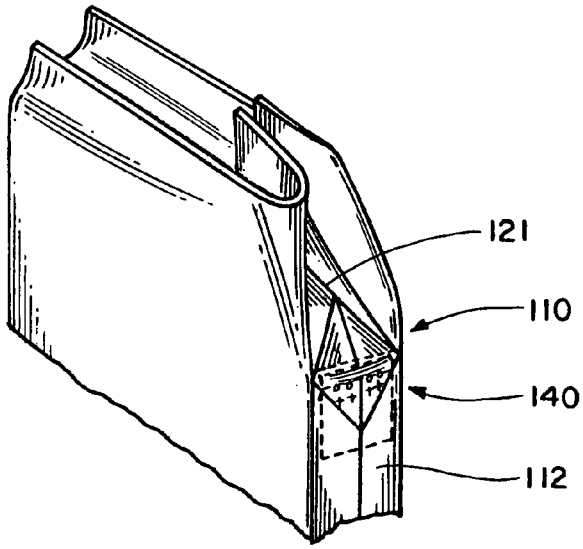
FIG. 10 is a fragmentary perspective of the present air valve incorporated into a side gusseted poly bag.
Figure 11:
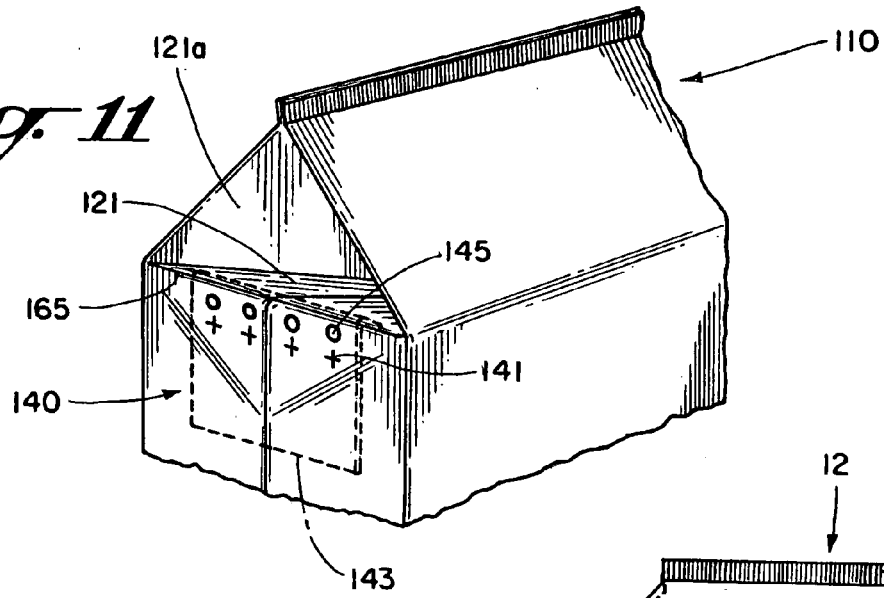
FIG. 11 is a perspective view of the side gusseted bag illustrated in FIG. 10 with the top heat sealed.
Figure 12:
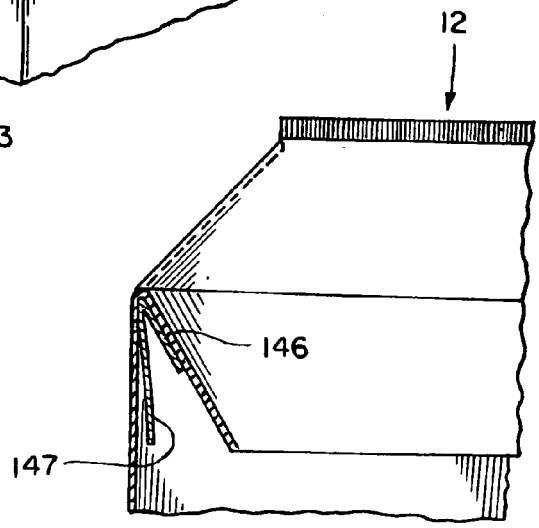
FIG. 12 is a fragmented longitudinal section showing the attached position of the flap valve illustrated in FIGS. 10 and 11.

The present air valve can be incorporated in a variety of different types of poly bags including the square top and square bottom poly bag illustrated in FIGS. 1 to 9, the side gusseted poly bag illustrated in FIGS. 10, 11, and 12 and open bottom bags(not illustrated).

Figure 1:
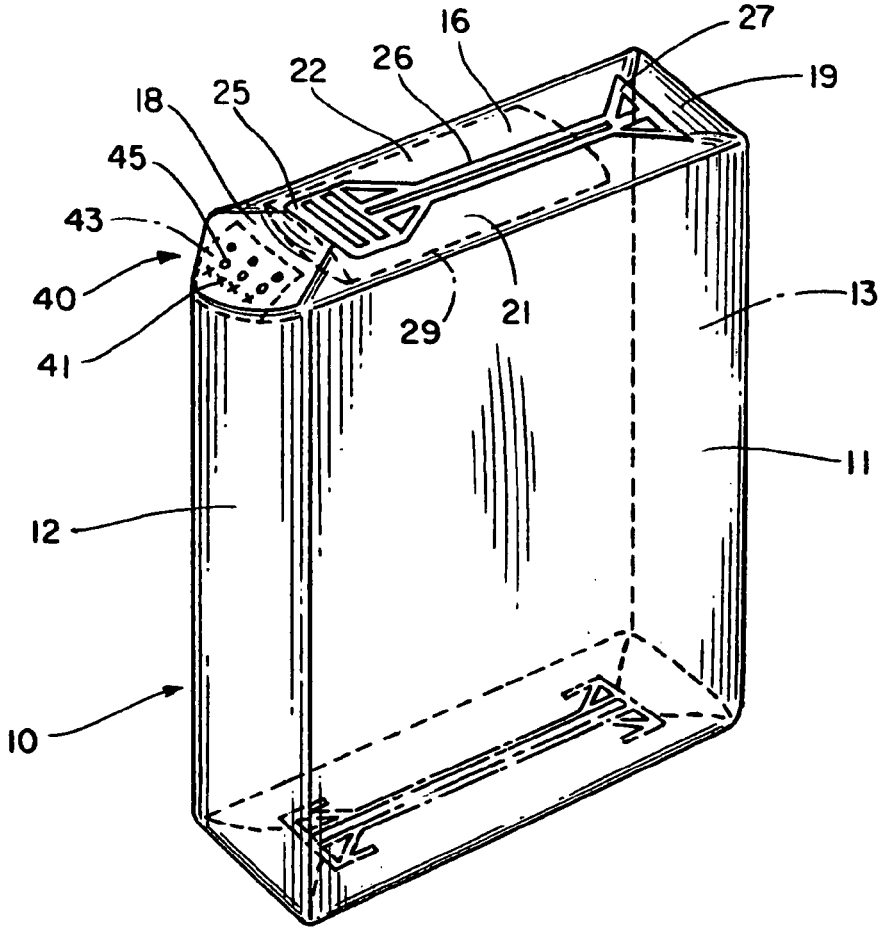
FIG. 1 is a perspective view of a top/square bottom bag with the air valve shown partly in dotted lines.
Figure 2:
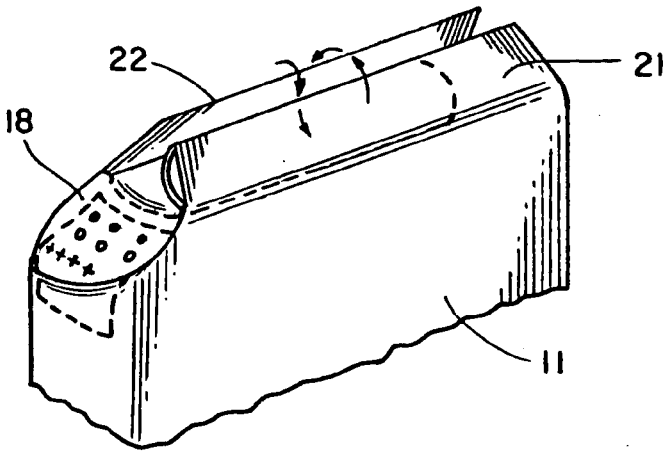
FIG. 2 is a fragmentary perspective view similar to FIG. 1 illustrating the manner of folding.

Referring to the drawings and particularly FIGS. 1 and 2, the square bottom bag 10 is illustrated including a front panel 11, side panels 12 and 13, rear panel 15 (see FIG. 3), a top 16 formed by inwardly folding upper side panel portions 18 and 19 over which are folded front wall portion 21 and rear wall portion 22. The heat sealing lines are designated at 25, 26, and 27. A tubular panel 29 is fixed to side panel portions 18 by heat sealing at 30 (see also FIG. 3) and forms part of the filling tube chute. The upper bight portion 32 of sheet 21, is heat sealed by 25, 26, 27 to the front wall panel 21 and rear wall panel 22.

The heat seal at 25 and 26 does not attach the side wall portion 21 to the top panels 21 and 22 so that feeding tube 34 may be inserted between panel portions 21 and 22 and side panel portions 18 to fill the bag. At the right top portion of the bag, however, heat sealing portion 27 does seal top panels 21 and 22 to the side panel portion 19 so that the right top portion of the bag is always sealed.

Figure 5:
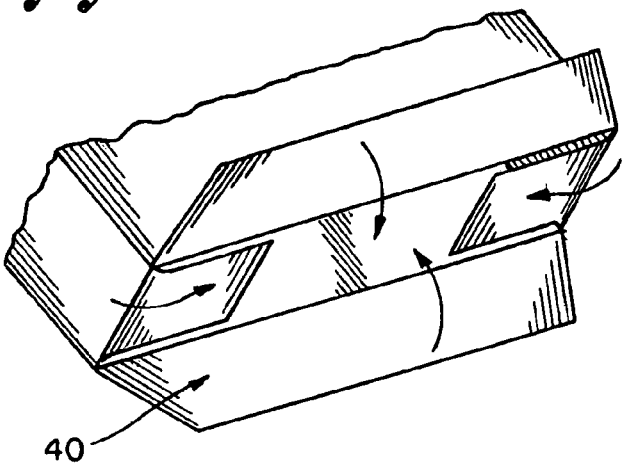
FIG. 5 is a fragmentary view of the square bottom of the bag shown in FIGS. 1 to 4.
Figure 6:
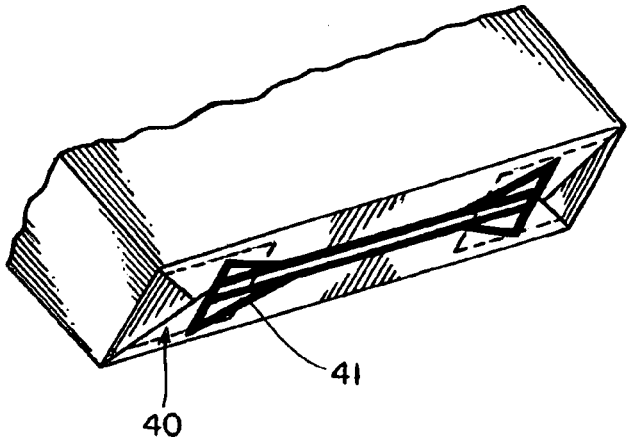
FIG. 6 is a fragmentary view of the bottom of the bag shown in FIG. 5 after heat sealing.

In FIGS. 5 and 6, the square bottom 40 of the bag is illustrated with appropriate heat sealing lines 41.

Figure 3:
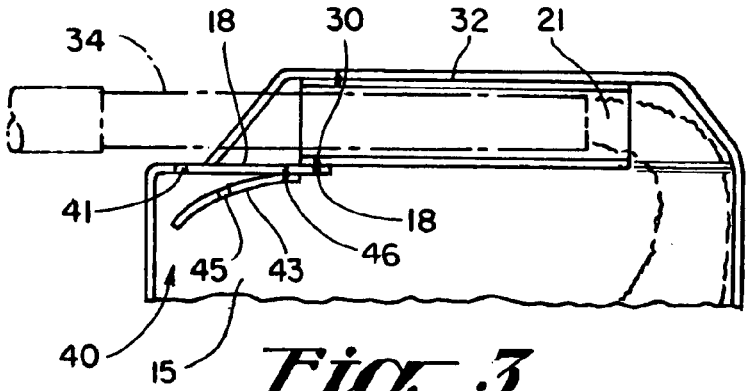
FIG. 3 is a vertical section through the upper part of the bag.

As seen in FIGS. 1 to 4, an air escape valve 40 is illustrated including four cross-slitted openings 41 in side panel portion 18 and a flap valve 43 having a plurality of round holes 45 therein that are offset inwardly relative to the bag with respect to the cross slit openings 41 to achieve the desired sealing of the cross slit openings 41 as the flap valve moves upwardly as seen in FIG. 3, closing off the openings 41.

Figure 4:
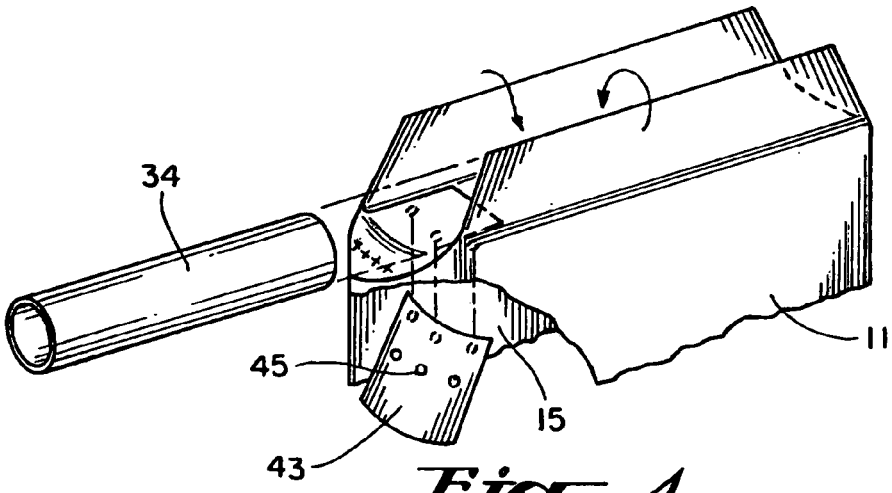
FIG. 4 is an exploded perspective view similar to FIG. 2 showing the manner of mounting the flap valve with an exemplary filling tube.

The flap valve 43 is generally rectangular and is heat sealed at 46 to the underside of the side panel portions 18, as seen in exploded fashion in FIG. 4.

Figure 7:
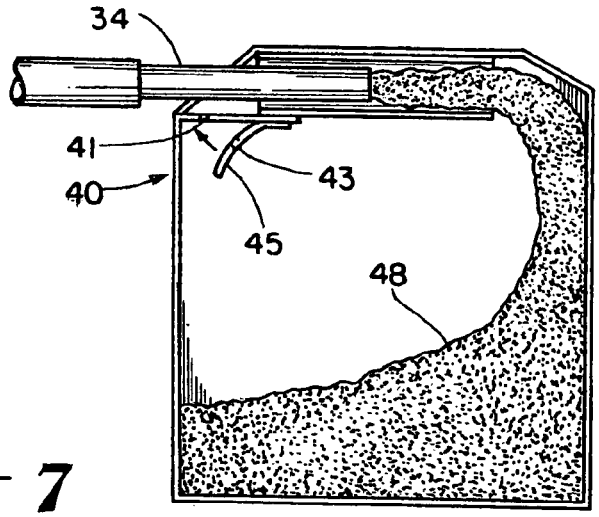
FIG. 7 is a vertical longitundinal section through the bag during filling.

As seen in FIGS. 7, 8, and 9, as material is discharged into the bag from the feeding tube 34, material in the bag fills the bag diagonally as seen at 48 in FIGS. 6 and 49 in FIG. 7 relative to the corner of the bag at which the air valve 40 is located. This permits the valve 40 to remain open to permit air to escape until the bag is almost completely filled and is an important aspect of the present invention.

As seen in FIG. 9, when the bag becomes almost completely filled, the valve 40 seals the opening 41 and as the feeding tube 34 is withdrawn from the chute 21, material collapses the heating chute against the top wall portions 21 and 22.

As mentioned above, as the bag fills, air exits the bag through holes 43 and slitted opening 41. Air flowing through the holes 43 maintains the flap 45 in an opened position and prevents inadvertent closure. In some cases this is not a problem, and in those cases it may be possible to eliminate the holes 43. It should be understood that the material itself and not air impinging on the lower surface of the flap 45 closes the valve to the position illustrated in FIG. 9.

A gusseted poly bag 110 is illustrated in FIGS. 10, 11, and 12, incorporating the present air valve 140 that operates in substantially the same manner as the valve 40 in FIGS. 1 to 9 embodiment. In the gusseted poly bag 140, the inward extension 121 of the upper portion of side gusset 112 defines the chute 121*a* shown in FIG. 11, and a separate panel 21 is unnecessary as shown in FIGS. 1 to 9. Flap valve 143 is heat sealed at 146 to the outward part of folded in gusset portion 121. Cross slits 141 are formed in the upper reaches of the side gusset 112 slightly beneath the fold line 165. As in the FIGS. 1 to 9 embodiments, the holes 145 in the flap valve 143 are offset from the cross slitted openings 141. Valve 140 operates in the same fashion as in the FIGS. 1 to 9 embodiments but the location of the valve is slightly different.

The invention claimed is:

1. A fillable poly bag with an air vent valve, comprising: a poly bag having front, rear and side panels with a top and bottom, a filling chute beginning at the top of the bag near one corner and extending toward the other top corner, an air vent valve in the poly bag near said one corner and automatically closeable as the bag fills, said air vent valve including openings in the poly bag itself near said one corner, and a flap separate from the poly bag inside the poly bag adjacent said openings underneath the side panels therein movable from a first position permitting air to escape through the poly bag openings and a second position blocking air flow through the openings, said flap being automatically closeable upon filling as the filling material engages the flap and urges it against the side panel.

2. A fillable poly bag as defined in claim 1, wherein there are air vent holes in the flap.

3. A fillable poly bag as defined in claim 1, wherein said flap is movable to the second position in response to engagement by material as it fills the poly bag.

4. A fillable poly bag as defined in claim 2, wherein the openings in the poly bag and the holes in the flap are offset from one another when the flap is in the second position.

5. A fillable poly bag as defined in claim 1, wherein the poly bag is a square bottom and square top poly bag.

6. A fillable poly bag as defined in claim 1, wherein the poly bag is a side gusseted poly bag.

7. A fillable poly bag as defined in claim 1, wherein the openings are defined by crossed slits in the poly bag itself.

8. A fillable poly bag as defined in claim 2, wherein the holes are circular or elliptical.

9. A fillable poly bag with an air vent valve, comprising: a poly bag having front, rear and side panels with a top and bottom, a filling chute beginning at the top of the bag near one corner and extending toward the other top corner, means for venting air from the poly bag as a filling tube positioned in the filling chute discharges material into the poly bag, including a plurality of openings in the poly bag near said one corner of the poly bag, a generally rectangular flap valve mounted inside the poly bag adjacent said openings, said flap valve having holes therein which are offset from the openings in the poly bag so the openings are sealed as material escapes and closes the flap against the poly bag openings.

10. A fillable poly bag as defined in claim 8, wherein the openings are defined by crossed slits in the poly bag itself.

* * * * *